US005588513A

United States Patent [19]

Lin

[11] Patent Number: 5,588,513

[45] Date of Patent: Dec. 31, 1996

[54] TILT-LOCKING PULL HANDLE FOR A WHEELED SUITCASE

[76] Inventor: Jerhong Lin, 7548 Donegal Dr., Cupertino, Calif. 95014

[21] Appl. No.: 400,042

[22] Filed: Mar. 7, 1995

[51] Int. Cl.[6] ..... A45C 5/14; A45C 13/26

[52] U.S. Cl. ..... 190/115; 190/18 A; 190/39; 16/115; 280/37; 280/65.51

[58] Field of Search ..... 16/115; 190/18 A, 190/39, 115; 280/37, 655, 655.1, 47.29

[56] References Cited

U.S. PATENT DOCUMENTS

| | | | |
|---|---|---|---|
| 2,375,338 | 5/1945 | Alexander | 190/18 A X |
| 3,606,372 | 9/1971 | Browning | 190/18 A X |
| 4,256,320 | 3/1981 | Hager | 280/37 |
| 5,075,926 | 12/1991 | Jeong | 190/115 X |
| 5,181,590 | 1/1993 | Carpenter et al. | 190/115 X |
| 5,197,579 | 3/1993 | Bieber et al. | 190/115 X |
| 5,317,795 | 6/1994 | Bolton et al. | 190/115 X |
| 5,374,073 | 12/1994 | Hung-Hsin | 190/18 A X |
| 5,394,965 | 3/1995 | Kho | 190/115 |
| 5,431,262 | 7/1995 | Rekuc et al. | 190/18 A |

FOREIGN PATENT DOCUMENTS

| | | | |
|---|---|---|---|
| 226769 | 9/1985 | Germany | 190/115 |
| 998492 | 7/1965 | United Kingdom | 190/115 |
| 2270900 | 3/1994 | United Kingdom | 190/115 |

*Primary Examiner*—Sue A. Weaver
*Attorney, Agent, or Firm*—The Kline Law Firm

[57] ABSTRACT

A wheeled luggage comprises a tilt-locking pull handle having a rod member on its lower end, a rod receiving mechanism for slidably receiving the rod member, and a locking mechanism for locking the rod member to prevent it from moving downward when the wheeled luggage is tilted for moving, and unlocking the rod member when the wheeled luggage is repositioned to an upright position. It provides a very simple and reliable pull handle locking mechanism which is controlled by tilting the wheeled luggage.

2 Claims, 5 Drawing Sheets

TILT-LOCKING PULL HANDLE FOR A WHEELED SUITCASE

BACKGROUND OF THE INVENTION

1. Field of the Invention

This invention relates to the design of a pull handle for a wheeled suitcase, and more particularly, to a tilt-locking pull handle which is locked when the wheeled suitcase is tilted for moving, and unlocked when the wheeled suitcase is repositioned to an upright position.

2. Description of the Prior Art

Wheeled suitcases are popular for traveling because they can easily be pulled rather than carried. A slidable pull handle is commonly used in many wheeled suitcases to facilitate the pulling or pushing of a wheeled suitcase. In order to use such slidable pull handle, a user must pull the pull handle first to an utmost position, and then tilt the wheeled suitcase toward its rear end for moving.

Conventional pull handles usually comprise at least one slidable rod member on its lower end which is slidably engaged in a rod receiving means installed on the rear side of a wheeled suitcase. The pull handle must be maintained in its utmost position when pulling or pushing a wheeled suitcase. If the slidable pull handle can not be fixed in its utmost position, it can cause great difficulty in moving the wheeled suitcase because the pulling or pushing of the wheeled suitcase may become uncontrollable.

In order to maintain the rod member in its utmost position, two types of mechanical devices are usually used inside a rod receiving means for fixing the rod member. The first type of mechanical device is a rod detention which can temporarily confine the lower end of the rod member in the utmost position of the rod receiving means. The lower end of the rod member can pass through the rod detention by a forceful pull or push action when it reaches the rod detention. The rod detention can resist certain pushing forces from the top of a pull handle when its rod member is confined at the utmost position. But when such wheeled suitcase is pushed through an uneven surface or maneuvered unevenly, the rod detention can easily be forced through by the rod member and thus may cause a lot of inconveniences in moving such wheeled suitcase.

The second type of mechanical device is a manual locking device which can reliably lock a slidable rod member at its utmost position. Since the on and off of the manual locking device is controlled by a manual switch, frequent access of the manual switch may become necessary when maneuvering such wheeled luggage, and thus may cause some inconvenience. Besides, the manual switch itself may increase the complexity and cost of the wheeled luggage.

SUMMARY OF THE INVENTION

It is therefore the goal of the present invention, by overcoming the limits of the prior art, to devise a new pull handle locking mechanism which can lock a slidable rod member when a wheeled luggage is tilted for moving, and unlock the slidable rod member when the wheeled luggage is repositioned to an upright position.

Briefly, in a preferred embodiment, the present invention includes a wheeled suitcase comprising:

(1) a substantially rectangular body portion;

(2) a plurality of wheels mounted on the rear bottom end of the body portion;

(3) a pull handle having a gripping means for gripping the pull handle and at least one elongated rod member connected to the gripping means;

(4) rod receiving means mounted on the rear side of the body portion for slidably receiving the rod member of the pull handle; and (5) locking means installed in the rod receiving means for locking the rod member when the rod member is extended to an utmost position within the rod receiving means and the wheeled suitcase is tilted toward its rear end by using the gripping means of the pull handle, and unlocking the rod member when the wheeled suitcase is repositioned to an upright position.

It is an advantage of the present invention that the locking means of the wheeled suitcase locks the rod member to prevent it from moving downward when the wheeled suitcase is tilted for moving, and unlocks the rod member when the wheeled suitcase is repositioned to an upright position.

It is another advantage of the present invention that the locking means of the wheeled suitcase provides a simple and reliable locking mechanism which is controlled by tilting the wheeled suitcase only. No extra manual switch or control action is needed in controlling the locking mechanism.

These and other advantages of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
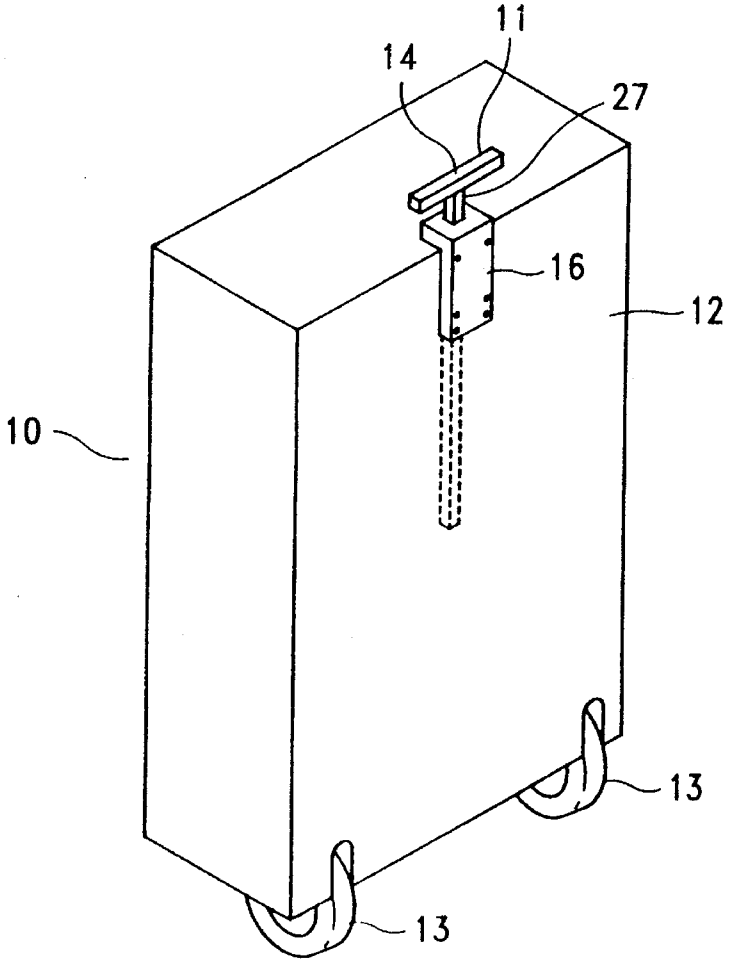
FIG. 1 is a perspective view of a wheeled suitcase in an upright position with a tilt-locking pull handle installed according to the present invention.

FIG. 1 is a perspective view of a wheeled suitcase 10 in an upright position with a tilt-locking pull handle 11 installed in it. The wheeled suitcase 10 comprises a substantially rectangular body portion 12, two wheels 13 mounted on the rear bottom end of the body portion 12, a pull handle 11 having a gripping means 14 for gripping the pull handle and one elongated rod member 27 connected to the lower side of the gripping means 14, a rod receiving means 16 mounted on the rear side of the body portion 12 for slidably receiving the rod member 27 of the pull handle 11. The pull handle 11 is in a retracted position. If the wheeled suitcase 10 is to be moved, the pull handle 11 should be pulled up first to its utmost position, and then the wheeled suitcase should be tilted toward its rear end so that it can be pulled backward or pushed forward. Such a condition is shown in FIG. 2.

Figure 2:
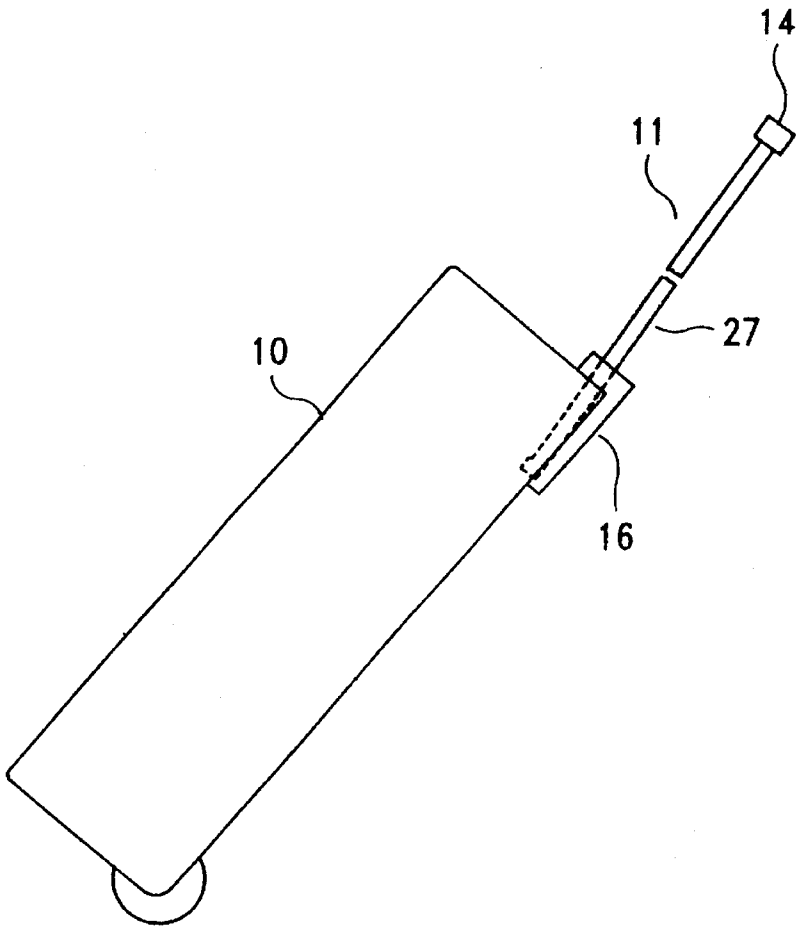
FIG. 2 is a side view of the wheeled suitcase shown in FIG. 1 which shows the wheeled suitcase is tilted toward its rear end with the pull handle extended to its utmost position.

FIG. 2 is a side view of the wheeled suitcase 10 which is tilted toward its rear end and ready for pulling or pushing. The pull handle 11 is extended to an utmost position within the rod receiving means 16. The wheeled suitcase 10 is tilted toward its rear end by using the gripping means 14 of the pull handle 11 so that the lower end of the rod member 27 can be locked by the locking means (not shown) installed inside the rod receiving means 16. The locking means locks the rod member 27 to prevent it from moving downward when the wheeled suitcase 10 is tilted toward its rear end, and unlocks the rod member 27 when the wheeled suitcase is repositioned to an upright position. The weight of the wheeled suitcase is used as the locking force to lock the lower end of the rod member 27 to the locking means when the wheeled suitcase 10 is tilted toward its rear end.

Figure 3:
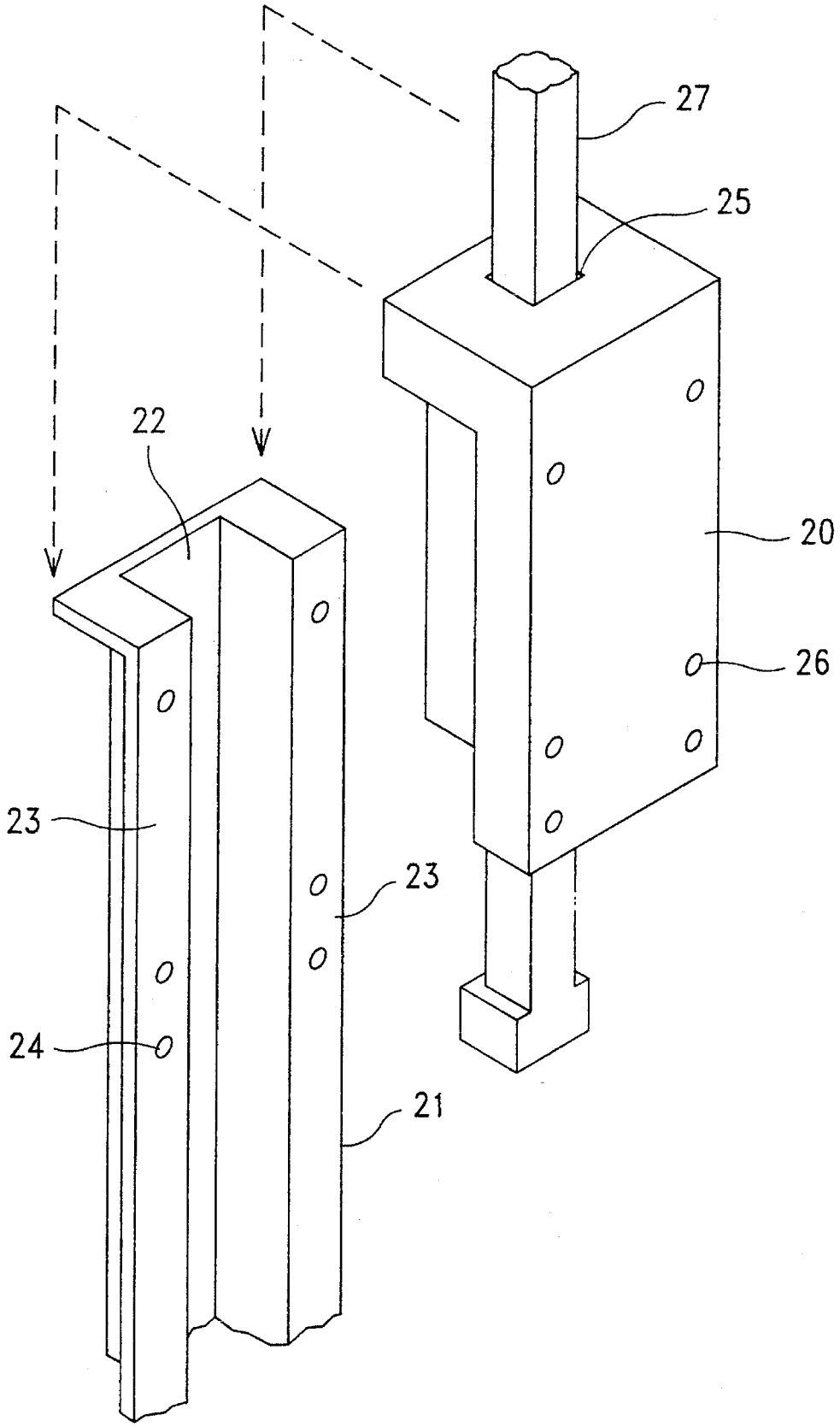
FIG. 3 is an exploded view of a head piece and a guiding track of a rod receiving means according to the present invention.

FIG. 3 is an exploded view of a head piece 20 with a rod member 27 installed in it and a guiding track 21 of the rod receiving means 16 shown in FIG. 1. The guiding track 21 comprises a U-shaped channel 22 along its centerline and two protruding edges 23 along two opposite ends of the U-shaped channel 22. Each of the two protruding edges comprises a plurality of fastening holes 24 for fastening the head piece 20. The head piece 20 comprises an opening 25 for the rod member 27 to pass through, and a plurality of fastening holes 26 for fastening the head piece 20.

Figure 6:
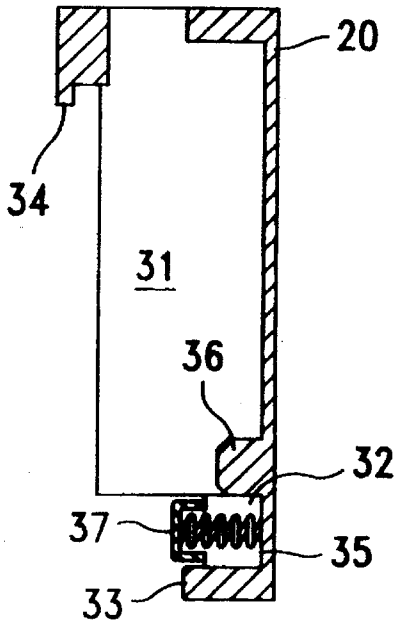
FIG. 6 is a side section view 5—5 of FIG. 5.
Figure 5:
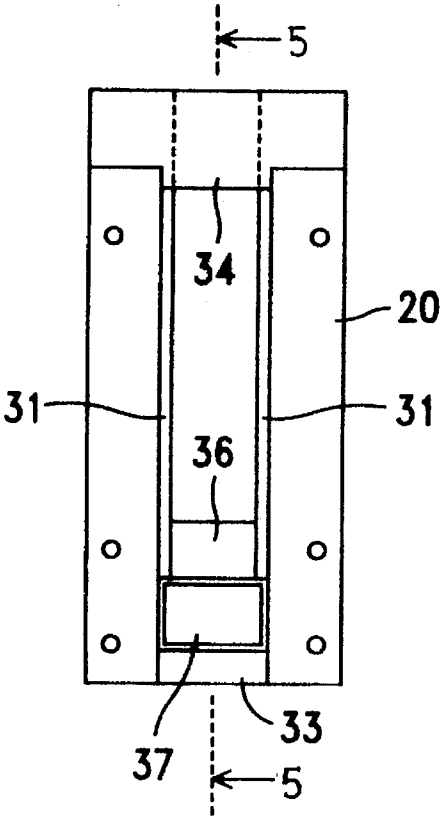
FIG. 5 is a front view of the head piece shown in FIG. 3.
Figure 4:
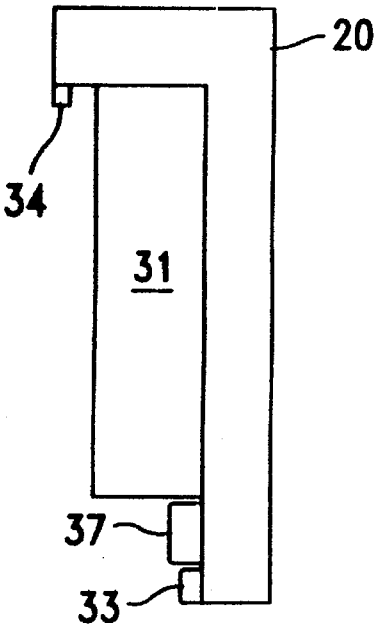
FIG. 4 is a side view of the head piece shown in FIG. 3.

FIGS. 4 and 5 are the side view and front view of the head piece 20 shown in FIG. 3. And FIG. 6 is a side section view 5—5 of the head piece 20 shown in FIG. 5. These figures show the detail construction of the head piece 20. The head piece 20 comprises a rod stop 31 for preventing the rod member 27 of FIG. 3 from being pulled out of the head piece, a locking means 32 for locking the rod member 27 to prevent it from moving downward, a protruding edge 33 on its lower end for maintaining the rod member 27 in a slidable position within the guiding track 21 of FIG. 3, and a hooking means 34 for hooking the top end of the guiding track 21. The locking means 32 comprises a locking recess 35 for preventing the rod member 27 from moving downward, a rod support 36 for engaging the lower end of the rod member 27 in order to support the weight of the wheeled suitcase 10 when the rod member 27 is locked by the locking means 32, and an elastic member 37 for unlocking the rod member 27.

Figure 7:
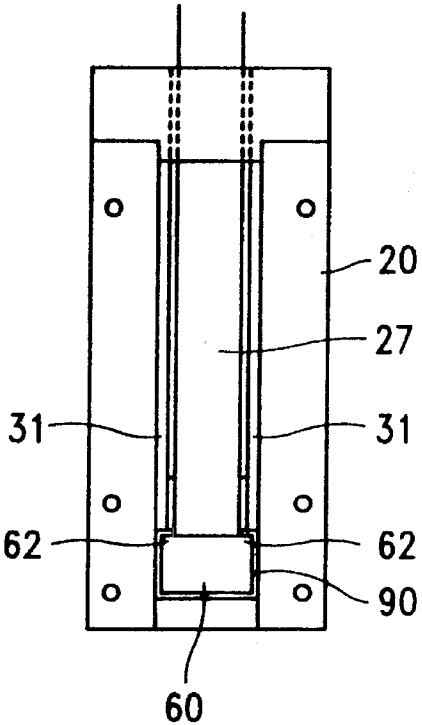
FIG. 7 is a front view of the head piece shown in FIG. 3 with a rod member installed in it.

FIG. 7 is a front view of the head piece 20 shown in FIG. 3 with the rod member 27 installed in it. The rod member 27 comprises a rod guide 60 on its lower end for guiding the rod member 27 along the guiding track 21 of FIG. 3. The rod guide 60 comprises two protruding edges 62 on its sides. The head piece 20 comprises a rod stop 31 for preventing the rod guide 60 from being pulled out of the head piece 20. The two protruding edges 62 of the rod guide 60 are stopped by the rod stop 31 when it reaches the utmost position 90.

Figure 9:
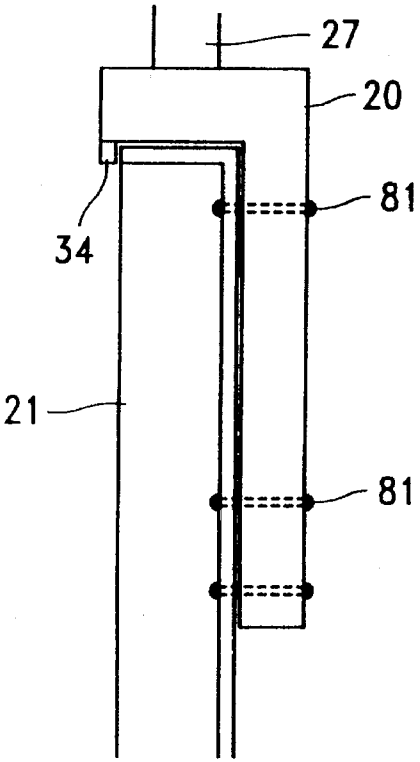
FIG. 9 is a side view of FIG. 8.
Figure 8:
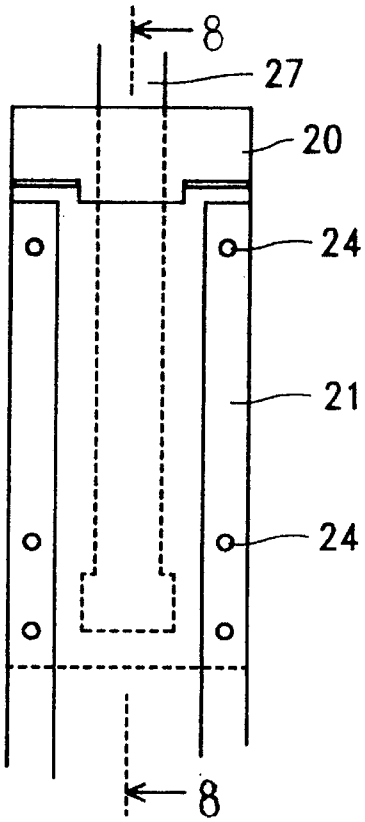
FIG. 8 is a front view of an assembled rod receiving means with a pull handle installed in it.

FIG. 8 is a front view of the assembled rod receiving means with a pull handle installed in it, and FIG. 9 is a side view of FIG. 8. The rod receiving means comprises an elongated guiding track 21 on its lower end for guiding the rod member 27 and a head piece 20 on its upper end fixedly connected to the guiding track 21 for restricting the rod member 27 within the guiding track 21. The head piece 20 comprises a hooking means 34 on its upper end for hooking the top end of the guiding track 21. And the lower end of the head piece 20 is fastened to the fastening holes 24 of the guiding track 21 by a plurality of fasteners 81. FIG. 9 shows that the head piece 20 is fixedly connected to the guiding tracking 21 by using the fasteners 81 on its lower end and the hooking means 34 on its upper end.

Figure 11:
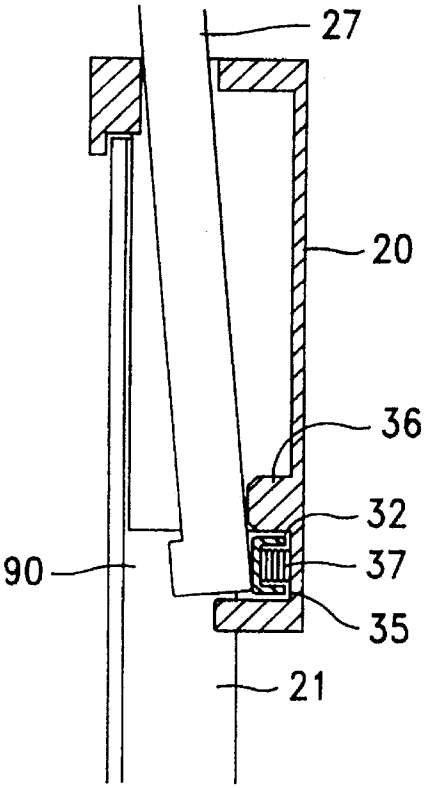
FIG. 11 is another side section view which shows the lower end of the rod member locked to the head piece of the rod receiving means when the wheeled suitcase is tilted toward its rear end.
Figure 10:
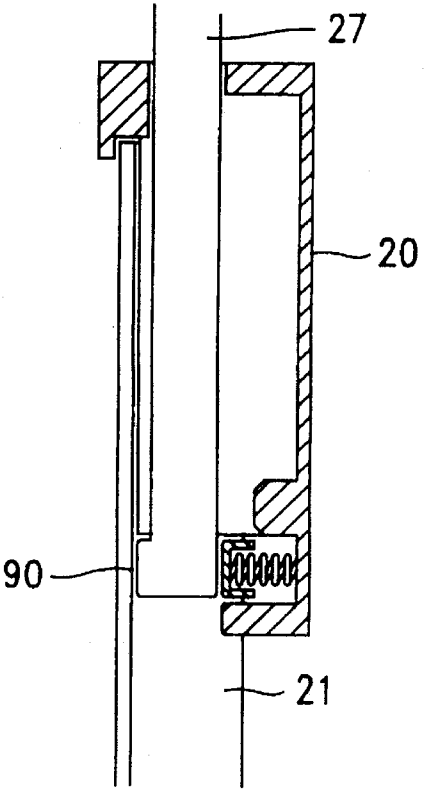
FIG. 10 is a side section view 8—8 of FIG. 8.

The locking and unlocking of the rod member 27 in the head piece 20 are shown in FIGS. 10 and 11. FIG. 10 shows that the rod member 27 is unlocked and is located at the utmost position 90 of the rod receiving means. The wheeled suitcase 10 is in an upright position at this time. FIG. 11 shows that the lower end of the rod member 27 is locked by the locking means 32 of the head piece 20 when the wheeled suitcase 10 is tilted toward its rear end as shown in FIG. 2 The lower end of the rod member 27 is forced by the weight of the wheeled suitcase to depress the elastic member 37 and to engage with the locking recess 35 so that the rod member 27 can be prevented from moving downward. The rod support 36 of the head piece 20 is engaged with the lower end of the rod member 27 in order to support the weight of the wheeled suitcase when the rod member 27 is locked by the locking means 32. After the wheeled suitcase is repositioned to an upright position as shown in FIG. 1, the pressure from the weight of the wheeled suitcase is released and the lower end of the rod member 27 is pushed back to its utmost position 90 by the elastic member 37 as shown in FIG. 10. The rod member 27 is then released from the locking recess 35. Briefly speaking, the operation of the locking means 32 is very simple and reliable. The lower end of the rod member 27 is moved from the utmost position 90 into the locking recess 35 when locking the rod member 27, and moved back to the utmost position when the wheeled suitcase 10 is repositioned to an upright position.

Figure 12:
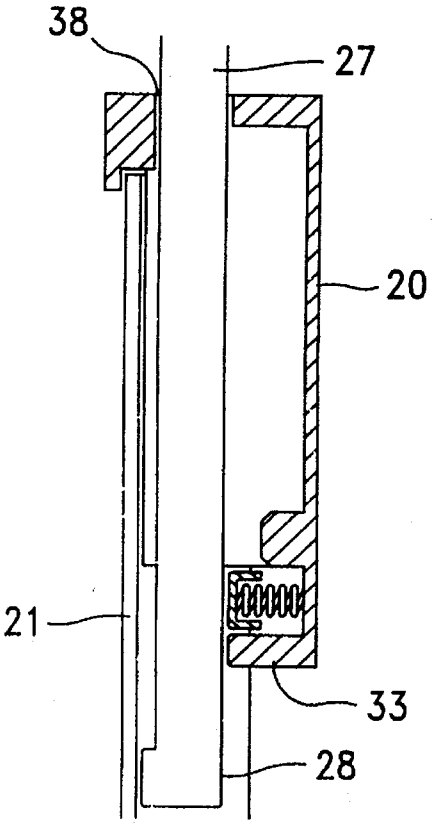
FIG. 12 is another side section view which shows the rod member in a slidable position inside the guiding track.

FIG. 12 is another side section view which shows the rod member 27 is in a slidable position inside the guiding track 21. The lower part of the rod member 27 is slidably engaged with the guiding track 21 and is restricted by both the opening 38 and the protruding edge 33 of the head piece 20 so that it can stay in a slidable position within the guiding track 21. The rod member 27 comprises a substantially straight contacting side 28 against the protruding edge 33 so that the rod member 27 can be evenly maintained in a slidable position within the guiding track 21 by the protruding edge 33.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A wheeled suitcase comprising:

(1) a substantially rectangular body portion having a rear end and a rear bottom end;

(2) a plurality of wheels mounted on the rear bottom end of the body portion;

(3) a pull handle having a gripping means for gripping the pull handle and at least one elongated rod member connected to said gripping means;

(4) rod receiving means mounted on the rear end of the body portion for slidably receiving the rod member of said pull handle; said rod receiving means comprising an elongated guiding track on its lower end for guiding said rod member and a head piece on its upper end fixedly connected to said guiding track for restricting said rod member at an utmost position within said guiding track wherein the lower part of said rod member is slidably engaged and restricted within said guiding track by said head piece; said guiding track comprising a U-shaped channel along its centerline and two protruding edges along two opposite ends of said U-shaped channel, each of said two protruding edges further comprising a plurality of fastening holes for fastening said head piece wherein said head piece is fastened to said fastening holes of said guiding track by a plurality of fasteners; and (5) locking means installed in said rod receiving means for locking said rod member to prevent said rod member from moving downward when said rod member is extended to said utmost position within said rod receiving means and said wheeled suitcase is tilted toward its rear end by using said gripping means of the pull handle, and unlocking said rod member when said wheeled suitcase is repositioned to an upright position;

wherein said head piece further comprises a hooking means for hooking the top end of said guiding track wherein said head piece is fixedly connected to said guiding tracking by using said fasteners on its lower end and said hooking means on its upper end.

2. A wheeled suitcase comprising (1) a substantially rectangular body portion having a rear end and a rear bottom end;

(2) a plurality of wheels mounted on the rear bottom end of the body portion;

(3) a pull handle having a gripping means for gripping the pull handle and at least one elongated rod member connected to said gripping means;

(4) rod receiving means mounted on the rear end of the body portion for slidably receiving the rod member of said pull handle; said rod receiving means comprising an elongated guiding track on its lower end for guiding said rod member and a head piece on its upper end fixedly connected to said guiding track for restricting said rod member at an utmost position within said guiding track wherein the lower part of said rod member is slidably engaged and restricted within said guiding track by said head piece; and (5) locking means installed in said rod receiving means for locking said rod member to prevent said rod member from moving downward when said rod member is extended to said utmost position within said rod receiving means and said wheeled suitcase is tilted toward its rear end by using said gripping means of the pull handle, and unlocking said rod member when said wheeled suitcase is repositioned to an upright position;

wherein said rod member comprises a rod guide on its lower end for guiding said rod member along said guiding track and said head piece of the rod receiving means comprises a rod stop for preventing said rod guide from being pulled out of said head piece wherein said rod guide is stopped by said rod stop when it is slidably extended to the utmost position; and wherein said locking means comprises an elastic member for unlocking said rod member wherein the lower end of said rod member depresses said elastic member when it is locked by said locking means, and is pushed back to its utmost position by said elastic member when it is released from said locking means.

* * * * *